US006387029B1

(12) United States Patent
Lencoski

(10) Patent No.: US 6,387,029 B1
(45) Date of Patent: May 14, 2002

(54) CUSHIONING CONVERSION MACHINE AND METHOD WITH STITCHING ASSEMBLIES

(75) Inventor: Michael J. Lencoski, Claridon Township, OH (US)

(73) Assignee: Ranpak Corp., Painesville, OH (US)

( * ) Notice: Subject to any disclaimer, the term of this patent is extended or adjusted under 35 U.S.C. 154(b) by 0 days.

(21) Appl. No.: 09/409,829

(22) Filed: Oct. 1, 1999

Related U.S. Application Data

(60) Provisional application No. 60/102,919, filed on Oct. 2, 1998.

(51) Int. Cl.[7] ..... B31B 1/00
(52) U.S. Cl. ..... 493/464; 493/967
(58) Field of Search ..... 83/846, 847, 678; 497/464, 967, 428, 63, 64

(56) References Cited

U.S. PATENT DOCUMENTS 3,717,074 A * 2/1973 Rasmussen
4,968,291 A * 11/1990 Baldacci et al.
5,340,638 A * 8/1994 Sperner
5,755,656 A * 5/1998 Beierlorzer
5,910,079 A * 6/1999 Watanabe
6,035,613 A * 3/2000 Lencoski et al.
6,159,137 A * 12/2000 Lee et al.

FOREIGN PATENT DOCUMENTS

GB 2332193 6/1999

* cited by examiner

*Primary Examiner*—Eugene Kim
(74) *Attorney, Agent, or Firm*—Renner, Otto, Boisselle & Sklar, LLP

(57) ABSTRACT

Cushioning conversion stitching/coining members each include a plurality of radially outwardly extending projections that meshingly engage during rotation. One stitching member includes a recess and the other stitching member includes cutting edges received in the recess to cut a row of slits in the overlapped portions of the stock material to form at least one row of tabs for interlocking the overlapped portions of the stock material. The cutting edges are radially positioned between adjacent projections of the second stitching member and circumferentially spans less than the circumferential space between adjacent projections. Additionally or alternatively, the projections are shaped so that there is exaggerated backlash between meshing projections.

8 Claims, 6 Drawing Sheets

CUSHIONING CONVERSION MACHINE AND METHOD WITH STITCHING ASSEMBLIES

RELATED APPLICATION DATA

This application claims the benefit of U.S. Provisional Application No. 60/102,919 filed Oct. 2, 1998.

FIELD OF THE INVENTION

This invention relates to a cushioning conversion machine and method and more particularly to improved stitching and/or coining means for such machines/methods.

BACKGROUND OF THE INVENTION

In the process of shipping an item from one location to another, a protective packaging material is typically placed in the shipping case, or box, to fill any voids and/or to cushion the item during the shipping process. Some conventional protective packaging materials are plastic foam peanuts and plastic bubble pack. While these conventional plastic materials seem to adequately perform as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials have made paper protective packaging material a very popular alterative. Paper is biodegradable, recyclable and composed of a renewable resource, making it an environmentally responsible choice for conscientious industries.

While paper in sheet form could possibly be used as a protective packaging material, it is usually preferable to convert the sheets of paper into a relatively low density pad-like cushioning dunnage product. This conversion may be accomplished by a cushioning conversion machine/method, such as those disclosed in U.S. Pat. Nos. 3,509,798, 3,603,216, 3,655,500, 3,779,039, 4,026,198, 4,109,040, 4,717,613 and 4,750,896, and also in U.S. patent applications Ser. Nos. 07/533,755, 07/538,181, 07/592,572, 07/734,512, 07/786,573, 07/840,306 and 07/861,225. (These patents/applications are assigned to the assignee of the present invention and their entire disclosures are hereby incorporated by reference.)

In the conversion machines/methods disclosed in the above-identified patents and applications, the cushioning product is produced by converting multi-layer paper stock material into a desired geometry. The cushioning product includes pillow-like portions formed by the lateral edges of the stock paper being rolled inwardly to form a pair of twin spirals. The central regions of this structure are then compressed, connected, and/or coined to connect the overlapped edge portions thereby forming a cushioning product with a central compressed portion and two lateral pillow-like portions. This compression, connection and/or coining is performed by a pair of rotating members each include a plurality of radially outwardly extending projections (i.e., spur teeth) that meshingly engage.

To maintain the intactness of the cushioning product, the central portion of the cushioning product has also been "stitched" to further prevent opening up or separation of the connected portions of the product, this commonly being referred to as "unzippering". For example, in U.S. Pat. No. 4,937,131 and/or U.S. Pat. No. 4,968,291, perforations are formed in the coined portion of the cushioning product by projection extending radially outward from the teeth of the rotating members. For another example, in U.S. patent application Ser. No. 08/607,607, tabs are formed in the coined portion by cutting edges that are radially positioned between the adjacent projections (spur teeth) on one of the rotating members and that circumferentially span the space between adjacent projections. (These patents and applications are assigned to the assignee of the present application and its entire disclosure is hereby incorporated by reference.)

Although the assemblies disclosed in the above-identified patents and applications adequately perform their coining, connecting and/or stitching functions, there is always room for more improvements, particularly improvements which allow these functions to be performed less power, less pinch pressure, and/or more control over the cushioning product's density.

SUMMARY OF THE INVENTION

The present invention provides a cushioning conversion machine in which cutting edges used to form cutting tabs in the coined portion of the cushioning product have an abbreviated cutting edge. Particularly, the cutting edges do not span the circumferential extent of the valley (i.e., the space between adjacent teeth) in which they are located. The concentration of the tab-cutting force in a limited region reduces power requirements and/or allows the reduction of pinch pressure between the rotating members. Also, a concave edge profile may be provided on either side of the cutting edge to enhance the shearing ability of the cutting edge during its approach.

Additionally or alternatively, the present invention provides a cushioning conversion machine in which the coining members have projections shaped so that there is exaggerated backlash between meshing projections. Specifically, the present invention includes the appreciation that such an arrangement provides a more pronounced coining as may be advantageous in certain situations, such as when a higher density pad is desired. Moreover, these "exaggerated backlash" projections provide a direct, noticeable, and predictable relation between the pad density and the pinch pressure between the coining members thereby allowing the density of a cushioning product may be selectively changed by adjusting the pinch pressure.

The foregoing and other features of the invention are hereinafter fully described and particularly pointed out in the claims, the following description and annexed drawings setting forth in detail a certain illustrative embodiment of the invention, this embodiment being indicative, however, of but one of the various ways in which the principles of the invention may be employed.

DRAWINGS

DETAILED DESCRIPTION

Figure 1:
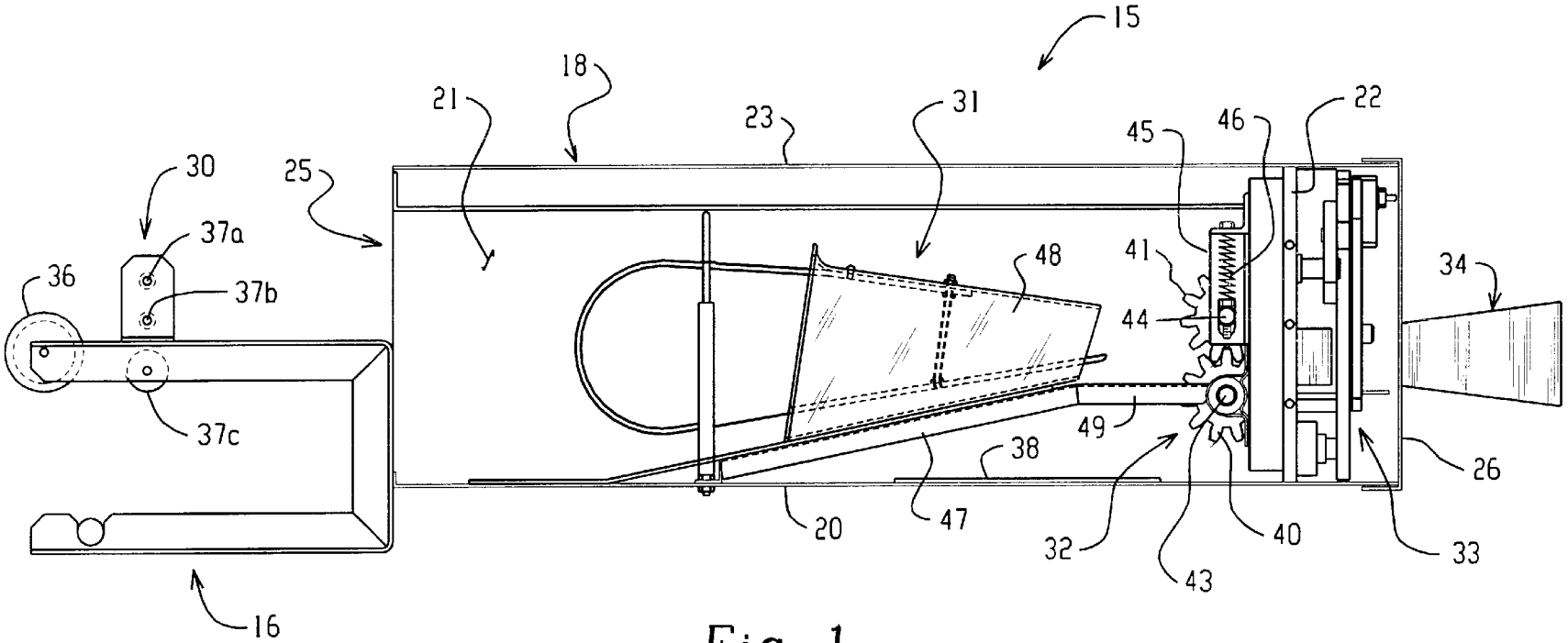
FIG. 1 is a side view of a cushioning conversion machine with a side panel of the machine's housing nearest the viewer removed to permit viewing of internal machine components, the machine including a stitching assembly that compresses, coins, and/or connects a central band of the cushioning product.

Referring now to the drawings in detail, and initially to FIG. 1, a cushioning conversion machine 15 according to the present invention is illustrated. The machine 15 has at its upstream end (to the left in FIG. 1) a holder 16 for a supply, such as a roll or rolls, of sheet-like stock material. The stock material preferably consists of three superimposed plies or layers of biodegradable, recyclable and reusable thirty-pound Kraft paper rolled onto a hollow cylindrical tube. Alternatively, the stock material preferably consists of two superimposed plies of fifty-pound Kraft paper rolled onto a hollow cylindrical tube. The cushioning conversion machine 15 converts the stock material into a strip having lateral pillow-like portions separated by a central band. This strip is connected along its central band to form a coined strip of cushioning product that may be severed, as by cutting, into sections, or pads, of a desired length.

The machine 15 includes a housing 18 having a base plate or wall 20, side plates or walls 21, and an end plate or wall 22 which collectively form a frame structure. The base wall 20 is generally planar and rectangular in shape. The housing also includes a top wall 23, which together with the base, side and end walls, form an enclosure.

The base and side walls 20 and 21 have at the upstream end of the housing inturned edge portions forming a rectangular border around a centrally located, and relatively large, rectangular stock inlet opening 25. This border may be viewed as an end plate or wall extending perpendicularly from the upstream edge of the base wall 20. It should be noted that the terms "up-stream" and "downstream" are herein used in relation to the direction of flow of the stock material through the machine 15. The end plate 22 extends perpendicularly from a location near, but inward from, the downstream end of the base wall 20. The end plate 22 is generally rectangular and planar and includes a dunnage outlet opening.

The housing (or frame) 18 also includes a front cover or plate 26 which extends perpendicularly from the downstream edge of the base wall 20. Thus, the end plate 22 and front plate 26 bound upstream and downstream ends of a box-like extended portion of the downstream end of the housing 18. The front plate 26 may be a door-like structure which may be selectively opened to access severing assembly components of the cushioning conversion machine 15.

The machine 15 further includes a stock supply assembly 30, a forming assembly 31, a feed/connecting assembly 32 powered by a stitching member drive motor, for example an electric motor (not shown), a severing assembly 33 powered by a severing motor, for example an electric motor (not shown), and a post-cutting or severing guide assembly 34. The stock supply assembly 30, including a constant entry roller 36 and separators 37*a*–37*c*, is mounted to an upstream side of the housing 18 or more particularly the upstream end plate or wall. The forming assembly 31 is located downstream of the stock supply assembly 30 interiorly of the housing and functions to form the stock material into a continuous three-dimensional strip of dunnage having portions of the stock material overlapped along the central region of the strip. The feed/connecting assembly 32 is located downstream of the forming assembly 31 and is mounted on an upstream side of the downstream end plate 22. On the opposite or downstream side of the downstream end plate 22, the severing or cutting assembly 33 is mounted. The motors are preferably mounted on the base wall 20 which may be provided with a transverse mounting plate 38 which forms part of the base wall or plate 20. The motors are disposed on opposite sides of the forming assembly 31. The post-cutting assembly 34 is located downstream of the severing assembly 33 and it is mounted on the front cover 26. Reference may be had to U.S. patent application Ser. No. 08/386,355 for a severing assembly similar to that illustrated, or to U.S. patent application Ser. No. 08/110,349 for another type of severing assembly.

The feed/connecting assembly 32 in the illustrated machine performs two functions. The feed/connecting assembly connects the overlapped portions of the stock material to maintain the three-dimensional shape of the strip of dunnage. The feed/connecting assembly also functions to feed stock material through the machine, as by pulling the stock material from the stock supply assembly and through the forming assembly 31. These dual functions are carried out by a pair of rotating stitching members and particularly gear-like members 40 and 41 described in greater detail below. In the illustrated embodiment by which the present invention is exemplified, one of the gear-like members 40 is mounted on a shaft 43 rotatably driven by the feed motor whereas the other gear-like member 41 is an idler carried on a floating shaft 44. The driven gear-like member 40 rotates about an axis fixed with respect to the front plate 22 whereas the other is carried on the floating shaft which is guided by guide slots in guides 45 for parallel translating movement toward and away from the driven shaft 43. The floating shaft, and thus the floating gear-like member, is resiliently biased by a spring 46 or other suitable resilient biasing means towards the driven gear-like member. The spring force may be adjusted to vary the squeeze force applied by the gear-like members to the strip of stock material passing therebetween from the forming assembly to the severing assembly.

In operation of the machine 15, the stock supply assembly 30 supplies stock material to the forming assembly 31. The forming assembly 31 causes inward rolling and shaping of the sheet-like stock material to form lateral pillow-like portions of a continuous strip of cushioning. The feed/connecting assembly 32 advances the stock material through the machine and also connects the central band to form a connected dunnage strip. As the connected dunnage strip travels downstream from the feed/connecting assembly 32, the severing assembly 33 severs or cuts the dunnage strip into sections, or pads, of a desired length. The severed or cut pads then travel through the post-severing assembly 34.

The machine 15 as thus far described is generally the same as the machine described in greater detail in U.S. Pat. No. 5,123,889 (hereby incorporated herein by reference) and reference may be had thereto for further details of the general arrangement and operation of the machine. However, it is noted that the illustrated forming assembly 31 is of the type described in pending U.S. patent application Ser. No. 08/386,355 which is hereby incorporated by reference. Also, the forming assembly is provided with a guide ramp 47 to which a shaping chute 48 is mounted, the guide ramp having an extended guide surface portion 49 extending from the downstream end of the shaping chute into close proximity to the gear-like members 40 and 41.

Figure 2C:
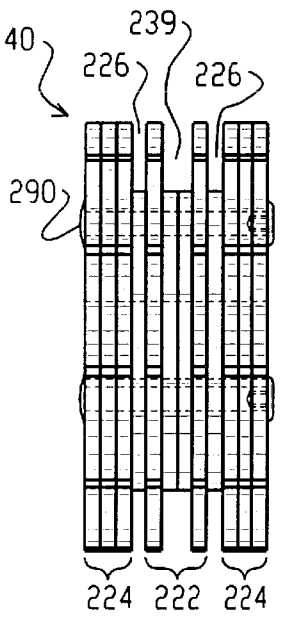
FIG. 2C is an assembled edge view of the female stitching member.
Figure 2B:
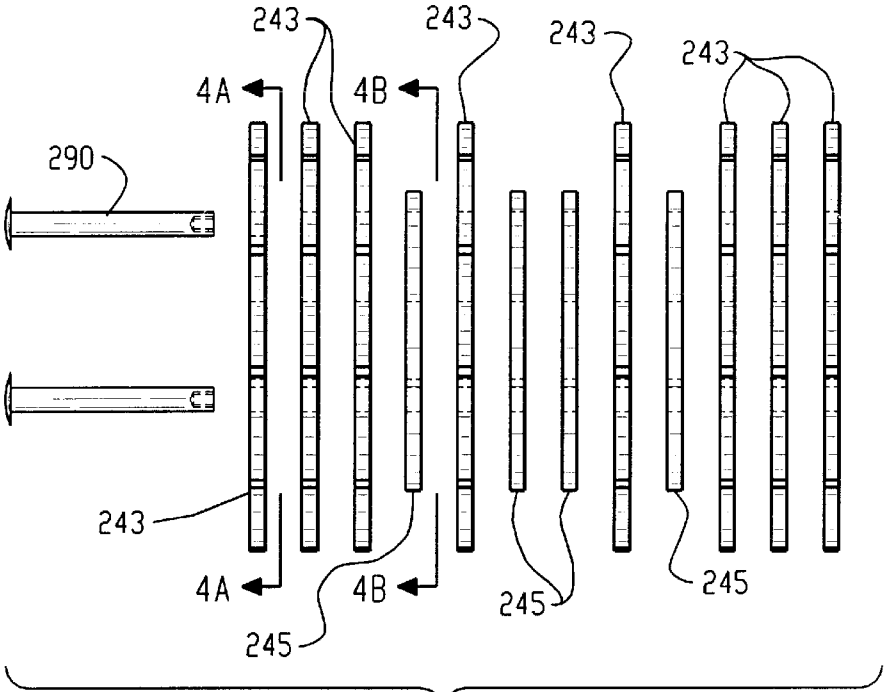
FIG. 2B is an exploded edge view of the female stitching member.
Figure 2A:
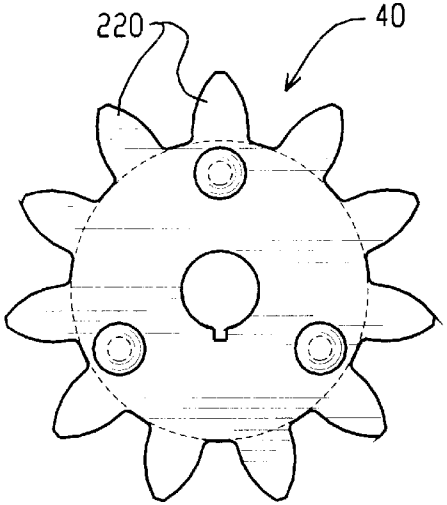
FIG. 2A is a side view of a rotating member of the stitching assembly, namely a female stitching member.
Figure 3C:
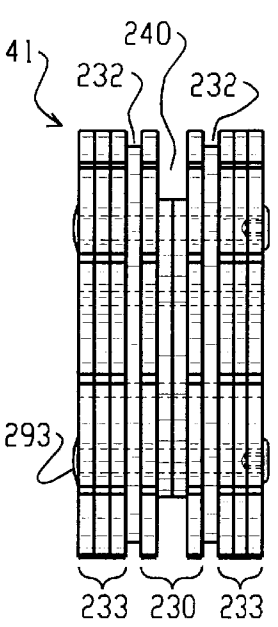
FIG. 3C is an assembled edge view of the male stitching member.
Figure 3B:
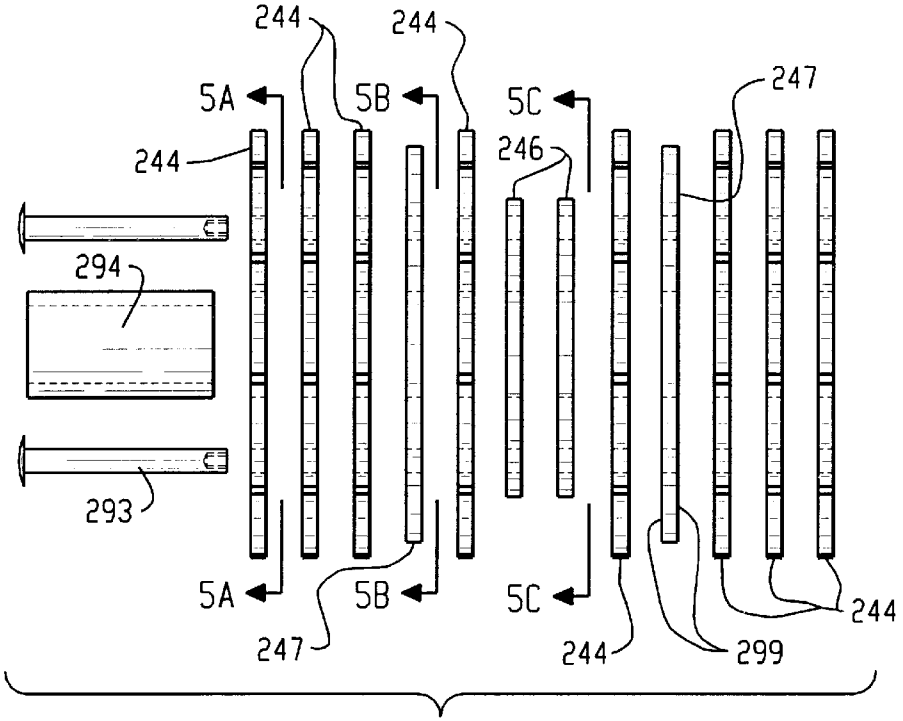
FIG. 3B is an exploded edge view of the male stitching member.

Referring now additionally to FIGS. 2 and 3, the stitching members 40 and 41 are shown in detail. As seen in FIGS. 2A–2C, the female stitching member 40 has around the circumference thereof a plurality of radially outwardly extending projections 220 preferably in the form of teeth, such as the illustrated spur gear teeth around its circumference. The teeth 220 are divided into a central segment 222 and outer or side segments 224 by annular recesses 226. The axial segments 220 and 224 and the recesses 224 preferably are symmetrically disposed with respect to the center plane of the female member 40.

The other stitching member, the male stitching member 41, includes a central segment 230, axially adjacent inner side segments 232, and outer side segments 233 respectively outwardly adjacent the inner side segments 232. The central segment 230 and outer side segments 233 have around the circumference thereof a plurality of radially outwardly extending projections 234, preferably teeth such as the illustrated spur gear teeth for meshing with the teeth 220 of the central segment 222 and outer side segments 224 of the female stitching gear 40 (FIGS. 2A–C). The space between the teeth 234 of the central segment 230 and/or the outer side segments 232 may be viewed as valleys 235.

Figure 3A:
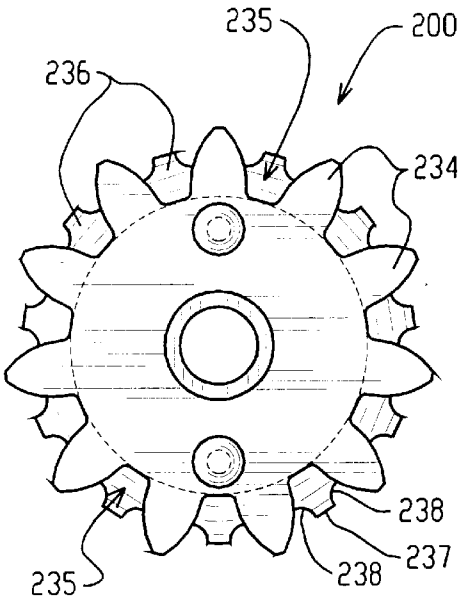
FIG. 3A is a side view of another rotating member of the stitching assembly, namely a male stitching member.

As is best seen in FIG. 3A, the inner side segments 232, also called cutting wheels, each have portions 236 that are aligned with the valleys 235 between the teeth 234 of the central segment 230 and/or the outer side segments 232. The valley-aligned portions 236 each include a cutting edge 237 and reliefs 238 on each side of the cutting edge 237. While the valley-aligned portions 236 span the circumferential space between the projections 234, the cutting edge 237 has a circumferential span less than the circumferential space between adjacent projections 234. Preferably, and as illustrated, the cutting edge 237 is a circumferential edge concentric with the root circle of the teeth 234. The reliefs 238 are in the shape of semi-circular cut-outs extending from one radial edge of the cutting edge 237 to at least the radial end of the valley-aligned portions 236. In this manner, a concave edge profile surrounds each radial side of the cutting edge 237 in each valley-aligned portion 236.

During rotation of the stitching members 40 and 41, the valleys 235 (between the teeth 234 of the male stitching member 41) receive the teeth 220 of the female stitching member 40 (FIGS. 2A–C). Consequently, during rotation of the stitching members 40 and 41, the valley-aligned portions 236 of the cutting wheels 232 will move past the synchronously moving teeth of the female stitching gear 40 and the cutting edges 237 are sequentially received in its recess 226. (Each of the cutting wheels 232 has a thickness slightly less than the width of the respective grooves 226 in the female gear 40.) Since the cutting edges 237 do not span the circumferential extent of the valley-aligned portions (such as is disclosed in U.S. patent application Ser. No. 08/607/607), the cutting force is concentrated in a limited section thereby reducing power requirements and/or allowing the reduction of pinch pressure between the stitching members 40 and 41. Also, although the notches 238 are not directly involved in the cutting process, the concave edge profile they provide is believed to enhance the shearing ability of the cutting edge 237 during its approach into the recess 226.

The center toothed segment 222 of the female gear 40 (FIGS. 2A–2C) and the center toothed segment 230 of the male gear 41 (FIGS. 3A–3C) may have respective centrally located annular grooves 239 and 240 that are aligned with one another and of equal width.

For ease in fabrication, the gears 40 and 41 preferably are formed by a stack of axially juxtaposed disk members preferably having a thickness that enables the disk members to be economically formed, for example by stamping or laser cutting from sheets or plates, typically of steel although other suitable materials (typically metal) may be employed as desired. The preferred gears illustrated in FIGS. 2 and 3 are composed of essentially five different flat disk members 243–247 all preferably having about the same uniform thickness, except for slight variations necessary to accommodate mating disk members and grooves between disk members. However, a different number disk members, which may be of significantly different thicknesses, may be used. For example, a single thicker disk member may be used in place of multiple disk members forming a single axial segment, if desired.

Figure 4A:
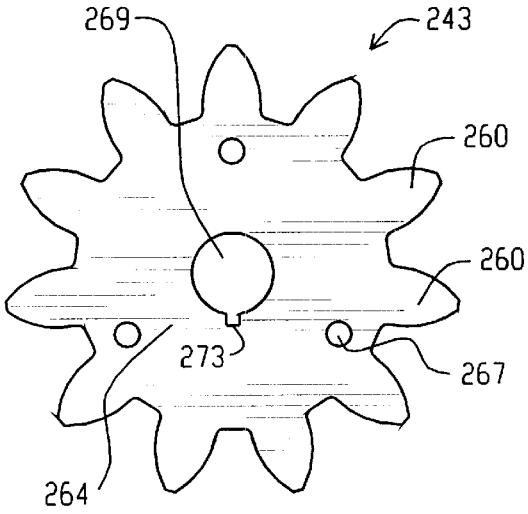
FIG. 4A is a view of a representative one of the toothed flat disk members forming a part of the female stitching member taken from the line 4A—4A of FIG. 2B.
Figure 5A:
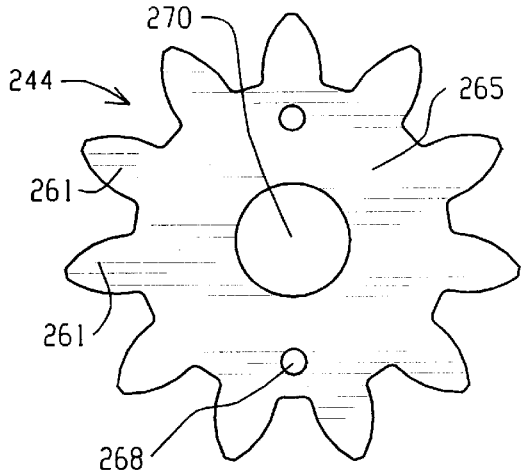
FIG. 5A is a view of a representative one of the toothed flat disk members forming a part of the male stitching member taken from the line 5A—5A of FIG. 3B.

The disk members 243 and 244 have the cross-section of a spur gear as shown in FIGS. 4A and 5A, the teeth 260 and 261 thereof extending radially outwardly from respective hubs 264 and 265 to form circumferentially spaced apart projections. The disk members 243 and 244 have one or more holes 267 and 268, respectively, for connecting pins and a center hole 269 and 270, respectively, for mounting to a shaft. As shown, the disk member 243 used to form the female gear 40, which is the driven gear, has three circumferentially equally spaced apart holes 267 in the hub 264 thereof for the connecting pins, and a center hole 269 that has a key slot 273 for accommodating a key on a drive shaft. The other disk member 244 is used to form the male gear 41 may have, for example, two diametrically opposite connecting pin holes 268 and no key slot if not driven as in the illustrated preferred embodiment. Aside from the connecting holes and center holes, the disk members preferably are otherwise identical (size and shape).

The disk members 245 and 246 have circular shapes and the disk member 247 has a generally circular shape with a scalloped edge to form the cutting edges 237 and the notches 238. The disk members 245 and 246 are preferably of the same diameter and preferably a diameter equal the diameter of the hub 264/265 from which the projections or teeth 260/261 of the disk members 243/244 extend radially outwardly. The disk member 247 preferably has a diameter larger than the diameter of the disk members 245 and 246. The disk member 245, used to form the female gear 202, has connecting holes 278 and a keyed center hole 279 like the toothed disk member 243. Similarly, the disk members 246/247, used to form the male gear, have connecting holes 282/283 and a center hole 286/287 like in the toothed disk member 244.

Eight toothed disk members 243 and four small diameter circular disk members 245 are assembled together to form the female gear 40 as shown in FIGS. 2B and 2C. Three toothed disk members 243 (FIG. 4A) are stacked together with the teeth thereof aligned with one another to form each outer side segment 224. The center segment 222 is formed by two smaller circular disk members 245 sandwiched between two toothed disk members 243 that have the teeth thereof aligned with one another and with the teeth of the outer disk segments 224. The smaller circular disk members 245 space the toothed gear members 245 apart and thus form the annular center groove 240 therebetween. Each side segment 224 is spaced from the center segment 222 by a small diameter disk member 243 which thereby forms the annular groove or groove segment 246 between the center and outer segments. The disk members are held together by connecting members 290, such as rivets or pins extending through the holes 267/278 in the disk members 243/245 which are axially aligned to receive the connecting rivets. Other suitable means may be employed to secure the disk members together. For example the disk members may be welded together and/or to a supporting shaft.

Figure 5B:
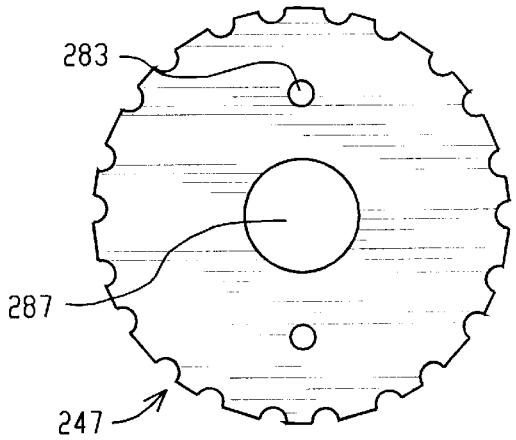
FIG. 5B is a view of a representative one of the large diameter circular flat disk members forming a part of the male stitching member taken from the line 5B—5B of FIG. 3B.
Figure 4B:
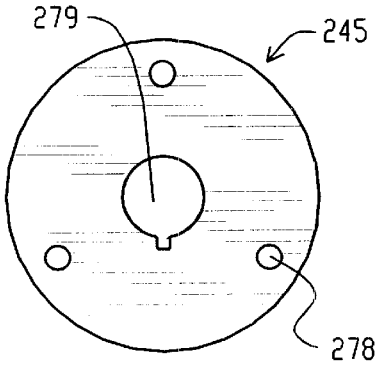
FIG. 4B is a view of a representative one of the small diameter circular flat disk members forming a part of the female stitching member taken from the line 4B—4B of FIG. 2B.
Figure 5C:
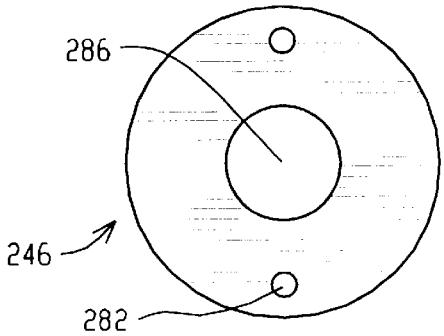
FIG. 5C is a view of a representative one of the smaller diameter circular flat disk members forming a part of the male stitching member taken from the line 5C—5C of FIG. 3B.

Eight toothed disk members 244, two small diameter circular disk members 246 and two large diameter disk members 247 are assembled together to form the male gear 41 as shown in FIG. 5. Three toothed disk members 244 are stacked together with the teeth thereof aligned with one another to form each outer side segment 233. The center segment 230 is formed by two smaller circular disk members 246 sandwiched between two toothed disk members 244 that have the teeth thereof aligned with one another and with the teeth of the outer disk segments 233. The smaller circular disk members 246 space the toothed gear members 244 apart and thus form the annular center groove 239 therebetween. Each side segment 233 is spaced from the center segment 230 by a large diameter disk member 247 which thereby forms the punching segment 232 between the center and outer segments. The disk members are held together by connecting members 293, such as rivets or pins, extending through the holes in the disk members which are aligned to receive the connecting rivets. Again, other suitable means may be employed to secure the disk members together, for example welding. A bushing 294 may extend through the center holes 270/286/287 of the disk members as shown.

As should now be evident, the gears 40 and 41 will rotate synchronously because of the meshed central and outer segments of the gears. The meshing gears pull the overlapped lateral edge portions of the stock material therebetween and while doing so will form dents or indentations in the stock material and thus thereby coin (mechanically permanently deform) the stock material. At the same time, the cutting edges 237 spanning the teeth 234 (FIG. 3A) of the adjacent toothed sections will move past the teeth 220 (FIG. 2A) of the female gear 40. At the nip of the gears, the then juxtaposed cutting edges and female gear teeth will cause adjacent portions of the stock material to move in opposite directions while the cutting edges cooperate to create a shearing action forming a slit through each one of the overlapped layers at each side of a thus formed smooth-edged tab portion being punched by the punch segment 237, this "punching" including cutting the slits to form the tabs.

Figure 6:
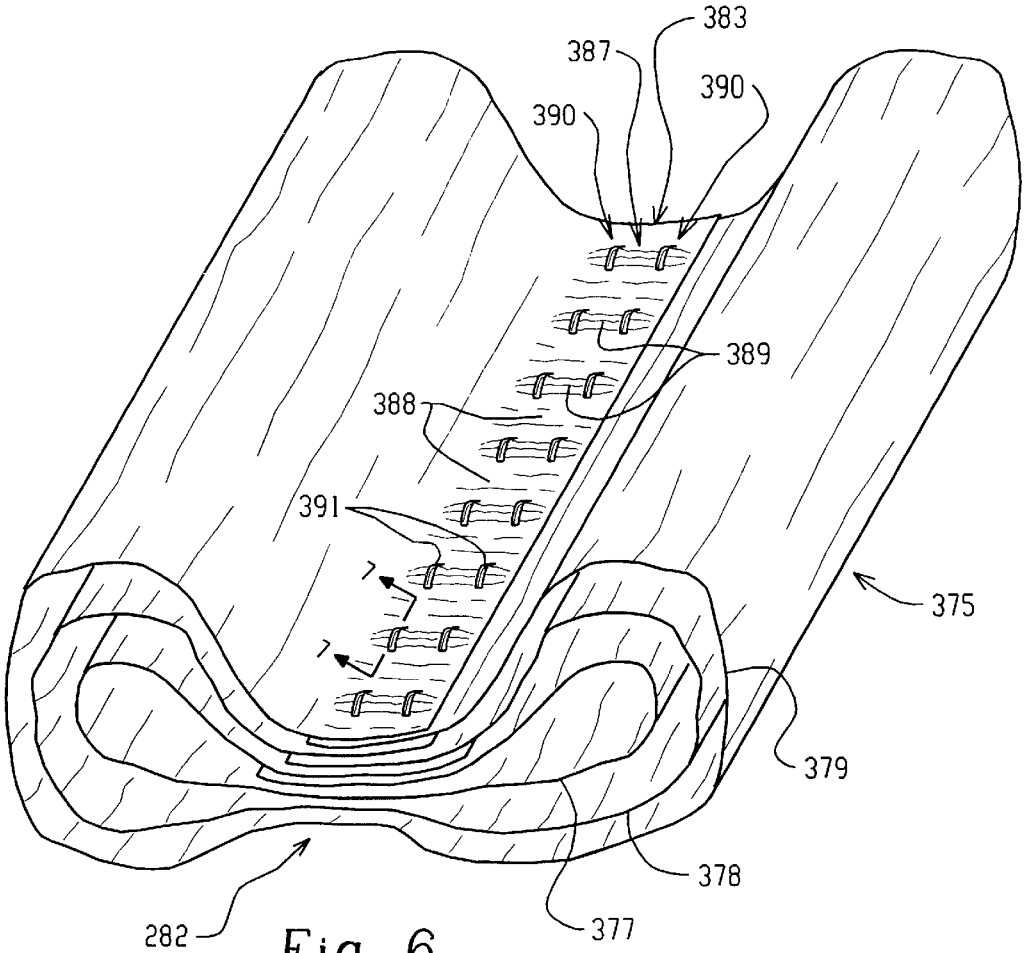
FIG. 6 is a schematic illustration of a cushioning product having a central band thereof connected by the stitching assembly.
Figure 7:
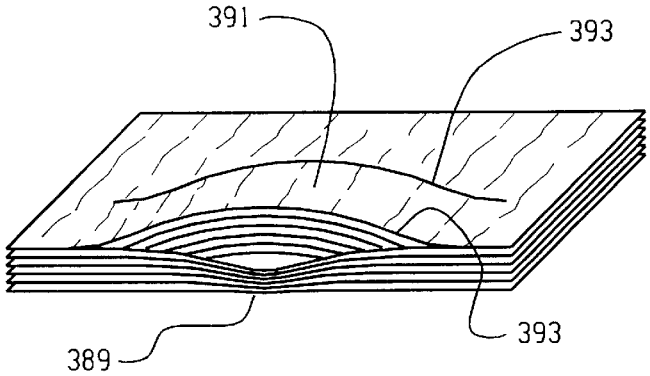
FIG. 7 is a cross-sectional view taken along the line 7—7 of FIG. 6.

Referring now to FIGS. 6 and 7, a cushioning product according to the invention is schematically illustrated at 375. The cushioning product comprises at least two and preferably three or more layers (plies) 377–379 of sheet-like material, these layers preferably comprising biodegradable, recyclable and reusable Kraft paper. The layers 377–379 have lateral edge portions thereof folded over the center portions and interleaved and/or overlapped as seen at 382. The overlapped and interleaved portions 382 are stitched together along a central seam or band 383. The stitching pattern produced by the stitching gears includes a central row 387 of outwardly directed dents 388 alternating with a inwardly directed dents 389. The central row of dents is bounded at each side thereof by a row 390 of tabs 391. The tabs, which are defined by laterally spaced apart slits 393, are dented or punched from the layer of stock material in a direction opposite the relatively adjacent dent of the central row.

The disk members that make up the gears 40 and 41 may be assembled in different patterns as may be desired for a particular application. The outer side segments of the stitching gears may be composed of a single toothed disk member, as might be desired for forming a smaller width stitching. Conversely, the number of toothed disk members may be increased to provide a wider segment or segments. Similarly, the number of spacer disk members and punch disk members may be varied to impart different features to the resultant strip of cushioning. By way of a specific preferred example, two of the toothed disk members 244 could be stacked together with the teeth thereof aligned with one another to form each outer side segment 233 and the center segment 230 could be formed by two smaller circular disk members 246 sandwiched between two pairs of toothed disk members 244 that have the teeth thereof aligned with one another and with the teeth of the outer disk segments 233.

Additionally or alternatively, the arrangement of the stitching members 40 and 41 relative to the cushioning product could be modified if necessary or desired. In the illustrated embodiment, the female stitching member 40 directly contacts the overlapped lateral edges 382 of the stock material layers 377–379 whereby the tabs 391 project outwardly from this side (the top side in FIG. 6) of the cushioning product. However, by way of a specific preferred example, the stitching members 40 and 41 could be reversed (with appropriate modifications to accommodate the drive/idle arrangement of the shafts 43 and 44) or the orientation of the forming assembly 31 could be inverted. With such a reversal or inversion, the male stitching member 41 would directly contact the overlapped edges of the stock material layers and the tabs 391 would project outwardly from the opposite side (the bottom side in FIG. 6) of the cushioning product.

Additionally or alternatively, the shape and/or size of the disk members that make of the stitching members 40 and 41 may be modified. With particular reference to the cutting disk 247 of the male stitching member 41 (or the cutting wheel 232 if the stitching member 41 is made in a different manner), its diameter could be chosen to modify the depth of the tab slits and/or to change the pinch pressure between the stitching members 40 and 41. Also the circumferential span of the cutting edges 237 may be modified and/or the shape of the reliefs 238 may be changed.

With particular reference to the toothed disk members 243 and 244 (or the segments containing the projections 220 and 234 if the stitching members and 41 are made in a different manner), the number of projections 220/234 could be increased/decreased. The illustrated stitching members 40/41 each include eleven projections 220/234 whereby the disks 243/244 each include eleven teeth 260/261. By way of a specific preferred example, modifications could be made so that the stitching members 40/41 each included ten projections 220/234. This modification in the projection pattern would of course, require similar modifications to the cutting wheel 232 and/or cutting disks 247.

Additionally or alternatively, the shape of the projections 220 and 234 could be changed. By way of a specific preferred example, the shape of the projections 220 and 234 may be changed to provide "more slop" or "exaggerated backlash" between meshing projections. In most conventional gear arrangements, this probably would not be preferred. However, the present invention includes the appreciation that such an arrangement provides a more pronounced coining as may be advantageous in certain situations, such as when a higher density pad is desired.

Moreover, the "exaggerated backlash" projections provide a direct, noticeable, and predictable relation between the coining profile and the pinch pressure between the stitching member 40 and 41. Since the coining profile of the cushioning product corresponds to its density, the density of a cushioning product may be selectively changed by adjusting the pinch pressure between the stitching members 40 and 41. For example, the cushioning conversion machine 15 may be modified to include a control mechanism, operably connected to the coining gears, which enables an operator to selectively vary the density of the cushioning product on demand. The control mechanism could include, for example, an accessible member outside of the housing for enabling easy operator adjustment of the density of cushioning product, such as is set forth in International patent application Ser. No. PCT/US96/10800. (This application is assigned to the assignee of the present invention and its entire disclosure is hereby incorporated by reference.) Additionally or alternatively, the pinch pressure of the stitching members 40 and 41 could be controlled by a microprocessor. In either event, it may be preferable to replace the floating shaft arrangement shown in FIG. 1 with the arrangement shown in U.S. patent application Ser. No. 08/487,179 to allow for easier adjustments of the pinch pressure between the members 40 and 41.

The preferred possible modification to the shape of the projections 220 and 234 will be explained in the context of replacing the gear disks 243 and 244 (FIG. 6) with the gear disks 1243 and 1244 shown in FIG. 7. However, the incorporation of the modified projections into stitching members 40 and 41 made in another matter is possible with and contemplated by the present invention. Moreover, the modified projections may be advantageous for coining-only connections and/or perforating/coining connections.

Figure 8:
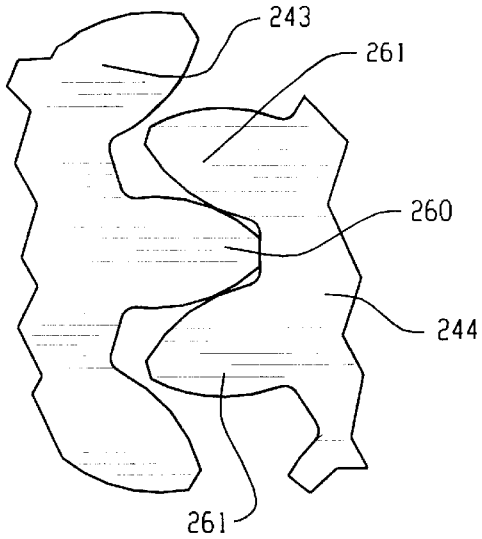
FIG. 8 is a partial plan view of two components of the stitching members, these components being shown in a tightly meshed condition.

In the illustrated stitching member 40/41, the teeth 260 and 261 of the gear disks 243 and 244 are shaped in a conventional gear fashion so that, when tightly meshed together they appear as shown in FIG. 8. In the context of the present invention, "tightly meshed" refers to when the top land of a projection 260 contacts the bottom land between projections 261. During actual operation of the cushioning conversion machine 15, the layers of stock material would be between the projections 220 and 234 formed by the teeth 260 and 261 whereby they would be so tightly meshed. Moreover, even conventional dry gears are usually not designed to be so tightly meshed together. Accordingly, it should be understood that the illustration in FIG. 8, and also FIG. 9, are provided for explanation not for the purpose of showing an intended working arrangement.

In FIG. 8, the disks 243 and 244 are shown in a tightly meshed with the depth direction of the tooth 260 being positioned perpendicular to the root circle of the disk 244. In this tightly meshed condition, the tooth 260 contacts side portions of the two adjacent teeth 261 thereby closing the space between the teeth 261. This contact is due to the geometry of the teeth 260/261, particularly the flat bottom lands, the flat top lands, and the abrupt fillet radius.

Figure 9:
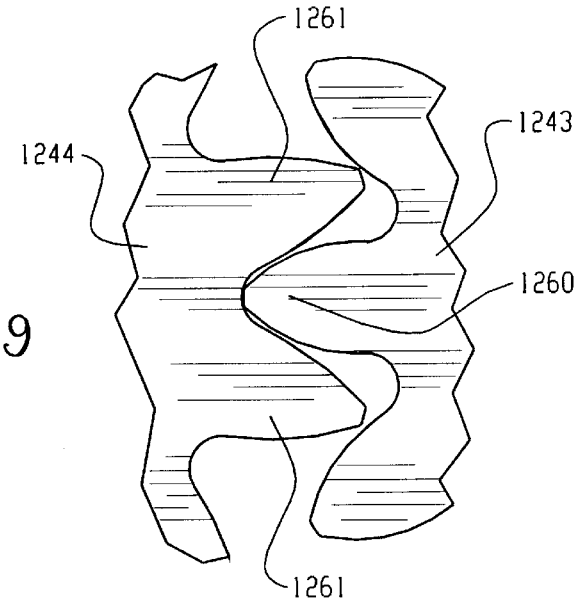
FIG. 9 is a partial plan view similar to FIG. 8 except showing modified versions of the tightly meshed components.

In FIG. 9, the disks 1243 and 1244 are shown in a tightly meshed with the depth dimension of the tooth 1260 being positioned perpendicular to the root circle of the disk 1244. Even in this tightly meshed condition, the tooth 1260 does not contact side potions of the two adjacent teeth 1261. This "spacing" or "slop" is due to the reconfigured geometry of the teeth 1260/1261, particularly the semi-circular bottom lands, the almost-pointed top lands, and the gradual fillet radius forming a parabolic valley between adjacent teeth.

Figure 10:
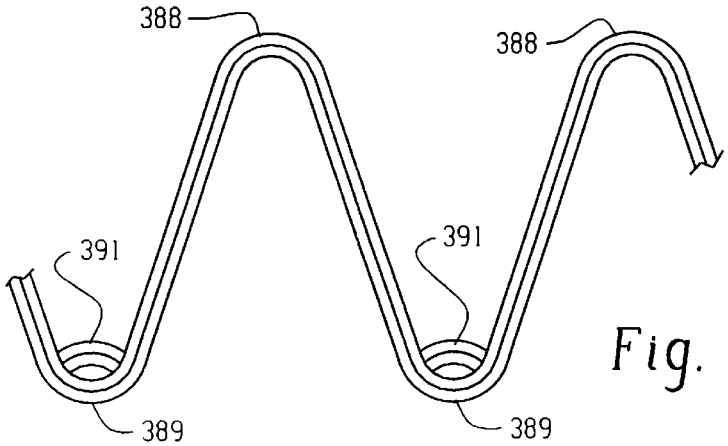
FIG. 10 is a schematic cross-sectional view of the central band of the cushioning product if the modified components shown in FIG. 9 are used in the stitching assembly.

If the stitching members 40 and 41 are modified to include the exaggerated backlash projections, the stitching pattern produced thereby is shown in FIG. 10. As illustrated, the stitching pattern will still include a central row 387 of outwardly/inwardly directed dents 388/389 and a row of tabs 391 longitudinally spanning between adjacent outwardly directed dents 388 (when viewed from the top in FIG. 10.) The height of the tabs 391 will be less than the height of the dents 388/389 due to the more pronounced profile of the dents 388/389.

Although the invention has been shown and described with respect to certain preferred embodiments, it is obvious that equivalent alterations and modifications will occur to others skilled in the art upon the reading and understanding of this specification. For example, the stitching gears may be used in other types of machines and methods to stitch overlapped portions of one or more layers of stock material. The present invention includes all such equivalent alterations and modifications.

What is claimed is:

1. A cushioning conversion machine comprising a conversion assembly that converts a sheet-like stock material into a three-dimensional strip of cushioning having overlapped portions of stock material;

the conversion assembly including a stitching assembly comprising a first stitching member and a second stitching member each comprising a plurality of radially outwardly extending projections that meshingly engage during rotation of the stitching members;

the first stitching member comprising at least one recess and the second stitching member comprising cutting edges received in the recess during rotation of the stitching members to cut a row of slits in the overlapped portions of the stock material to form at least one row of tabs for interlocking the overlapped portions of the stock material;

wherein the cutting edges are radially inwardly offset from the outer ends of adjacent projections of the second stitching member, are positioned between adjacent projections of the second stitching member, circumferentially span less than the circumferential space between adjacent projections and are spaced circumferentially from at least one of the adjacent projections by a radial relief.

2. A cushioning conversion machine as set forth in claim 1, wherein the second stitching member includes a cutting wheel having valley-aligned portions circumferentially spanning the space between the projections and wherein the valley-aligned portions include the cutting edges.

3. A cushioning conversion machine as set forth in claim 2, wherein the valley-aligned portions each further include a concave edge profile at each side of the cutting edge.

4. A cushioning conversion machine as set forth in claim 3, wherein the valley-aligned portions each include a relief forming the concave edge profile.

5. A cushioning conversion machine as set forth in claim 4, wherein the reliefs comprise semi-circular notches extending from one radial edge of the cutting edge to at least the radial end of the valley-aligned portions.

6. A cushioning conversion machine as set forth in claim 1, further comprising a control mechanism which controls the pinch pressure between the first and second stitching members.

7. A cushioning dunnage product made by the machine set forth in claim 1.

8. A stitching assembly for stitching together overlapped edge portions of stock material to produce a three-dimensional strip of cushioning, comprising a first stitching member and a second stitching member each comprising a plurality of radially outwardly extending projections that meshingly engage during rotation of the stitching members;

the first stitching member comprising at least one recess and the second stitching member comprising cutting edges received in the recess during rotation of the stitching members to cut a row of slits in the overlapped portions of the stock material to form at least one row of tabs for interlocking the overlapped portions of the stock material;

wherein the cutting edges are radially inwardly offset from the outer ends of adjacent projections of the second stitching member, are positioned between adjacent projections of the second stitching member, circumferentially span less than the circumferential space between adjacent projections and are spaced circumferentially from at least one of the adjacent projections by a radial relief.

* * * * *